United States Patent [19]

Glanvall

[11] Patent Number: 4,741,177

[45] Date of Patent: May 3, 1988

[54] OIL SEPARATOR IN A COOLANT SYSTEM

[75] Inventor: Rune V. Glanvall, Norrköping, Sweden

[73] Assignee: Stal Refrigeration AB, Norrköping, Sweden

[21] Appl. No.: 8,162

[22] Filed: Jan. 29, 1987

[30] Foreign Application Priority Data

Jan. 31, 1986 [SE] Sweden ..... 8600425

[51] Int. Cl.[4] ..... F25B 43/02

[52] U.S. Cl. ..... 62/470; 92/79; 417/368

[58] Field of Search ..... 62/84, 469, 470; 417/366, 368; 92/79

[56] References Cited

U.S. PATENT DOCUMENTS 2,074,323 3/1937 Borgerd ..... 62/470

3,408,828 11/1958 Soumerai et al. ..... 62/470

*Primary Examiner*—Ronald C. Capossela

*Attorney, Agent, or Firm*—Watson, Cole, Grindle & Watson

[57] ABSTRACT

In coolant systems oil mixed with the coolant is often removed in a separate oil separator on the high-pressure side of the compressor. In order to obtain a compact design in a coolant system comprising a unit including an oil-injection rotary compressor, a pressure-gas cooled driven motor and an oil separator, the oil separator is applied directly to the drive motor connected to the rotary compressor.

6 Claims, 2 Drawing Sheets

OIL SEPARATOR IN A COOLANT SYSTEM

FIELD OF THE INVENTION

The present invention relates to an oil separator applied to a drive motor connected to an oil-injection rotary compressor, located after the compressor outlet in the operating medium circuit.

BACKGROUND OF THE INVENTION

Oil-injection rotary compressors such as screw compressors of the SRM type, also known as Lysholm or twin-screw compressors, are usually provided with an oil separator, either connected separately in the system in which the compressor operates or, in some cases, integrated with the compressor.

Referring to FIG. 1 of the accompanying drawings, the purpose of an oil separator is to remove oil from an operating medium and return it to the lubricant circuit 13 and any cooling circuits of a compressor 15, as well as ensuring that the operating medium passed out into the system is not too oily.

A separate oil separator 16 is usually located after the compressor 15 on the high-pressure side. It is therefore dimensioned for high operating pressure as well as generally being relatively large. These two factors make it relatively expensive and cumbersome.

As stated above, the primary task of the oil is to lubricate the movable parts of the compressor. Secondary duties are sealing and cooling.

The objective is therefore first and foremost to ensure that sufficient oil is available for the lubrication system of the compressor. For compressors in small closed-circuit cooling or heating systems, for instance, where the risk of accumulating large volumes oil can be excluded and where the oil feedback from the system is under control, only so much oil need be removed from the operating medium and returned to the lubrication system of the compressor to ensure satisfactory functioning of the compressor. In these cases simpler and smaller oil-separation systems are adequate.

SUMMARY OF THE INVENTION

Applying the oil separator directly to the drive motor connected to the rotary compressor gives a compact design and a functioning unit comprising rotary compressor, drive motor and oil separator, together comprising a coolant system. The oil separator consists of at least one separation plate connected to the motor shaft and accompanying its rotary movement.

DESCRIPTION OF THE PREFERRED EMBODIMENT

Figure 2:
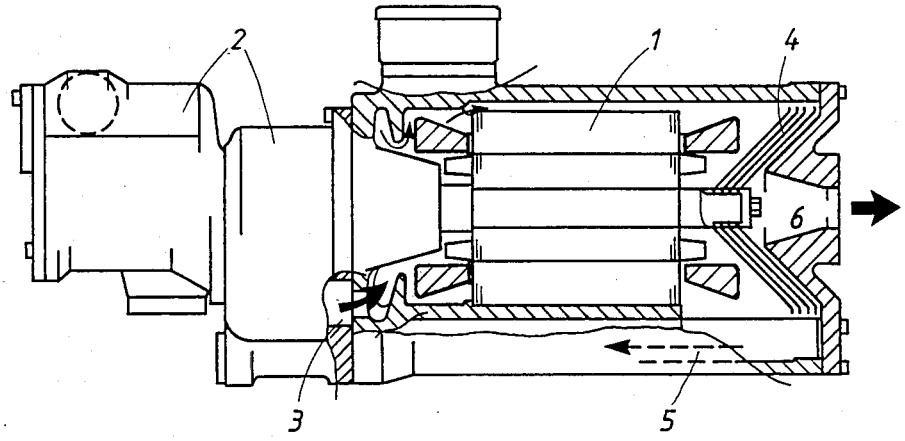
FIG. 2 shows a side view of an apparatus according to the present invention, the apparatus including a rotary compressor, drive motor and oil separator, a portion of the apparatus being shown in section.

The present invention relates to a small oil-injection screw compressor, see FIG. 2, of semi-closed design, having a pressure-gas cooled drive motor 1 located after the compressor 2 considered in the flow direction of the operating medium.

Figure 1:
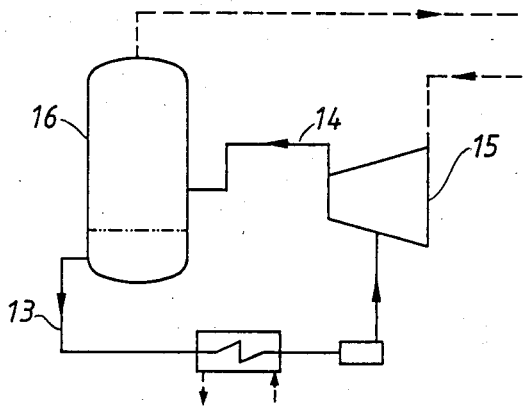
FIG. 1 shows an oil system in a refrigeration system.

The principle of the oil system can be seen in FIG. 1. The oil is conveyed to various lubrication points in the compressor to be passed on at an intermediate pressure level in the operating chamber of the compressor. The atomized oil mixed with the operating medium accompanies this out through a discharge gate and channels 3, passes over and past the motor 1 and then encounters an oil separator 4 consisting of a number of separation plates. These plates remove an adequate quantity of oil from the mixture of operating medium and oil, which is then returned to the oil system by way of a channel 5. The operating medium leaves the compressor 2 and motor 1 at the centre of the oil separator through an outlet 6.

Figure 3:
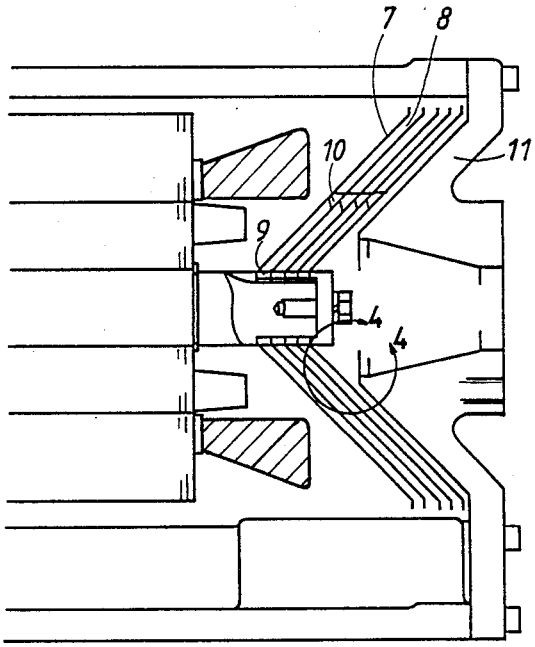
FIG. 3 schematically shows a portion of the apparatus shown in FIG. 2.

The oil separator, see FIG. 3, consists of a number of cones 7 with narrow gaps 8 formed by spacers 9 and possibly by notches 10 on the actual cone surface. The element is secured directly to the motor shaft and is thus driven at the same speed. The end-piece 11 of the stator housing at the mouth of the cone is similarly shaped and a narrow gap is thus also formed between the end-piece and cone.

Close to the motor shaft the cones 7 are provided with at least two holes 12.

The mixture of operating medium and oil endeavours to reach the outlet 6 and is thus forced to pass through the gaps 8 towards the center and through the holes 12 before reaching the outlet. On its way the oil particles will come into contact with the cones and will be thrown radially outwards, encountering the next cone surface and being pressed out to the periphery by centrifugal force. It is finally thrown out towards the inner walls of the stator housing, collected at the bottom near the channel 5 and returned to the lubrication system. The difference in density between the oil and the operating medium is such that the medium is unable to force the oil particles in towards the centre and the outlet during passage through gaps. When the operating medium reaches the holes 12 it will flow axially through them to the outlet.

What is claimed is:

1. An apparatus for use in compressing an operating medium in a coolant system, said apparatus comprising an oil-injection rotary compressor that provides a mixture of oil and compressed operating medium, a drive motor connected to said oil-injection rotary compressor, said drive motor including a drive shaft having an end which is remote from said oil-injection rotary compressor, and at least one separation plate connected to the remote end of said drive shaft and against which the mixture of oil and compressed operating medium flows, each separation plate including a hole therein, rotation of each said separation plate by rotation of said drive shaft causing oil in said mixture of oil and compressed operating medium to be forced radially outwardly while the compressed operating medium passes radially inwardly thereof and through the hole therein, such that the oil and the compressed operating medium are separated.

2. An apparatus according to claim 1, wherein each separate plate is conical.

3. An apparatus according to claim 1, wherein at least two separation plates are connected to the remote end of said drive shaft, each pair of adjacent separation plates being separated by a gap.

4. An apparatus according to claim 3, wherein each separation plate is provided with at least two diametrically located holes for through flow of compressed operating medium.

5. An apparatus according to claim 3, wherein each pair of adjacent separation plates is separated by a spacer element.

6. An apparatus according to claim 3, wherein at least one separation plate of each pair of adjacent separation plates includes a notch to provide said gap therebetween.

* * * * *

UNITED STATES PATENT AND TRADEMARK OFFICE

CERTIFICATE OF CORRECTION

PATENT NO. : 4,741,177

DATED : May 3, 1988

INVENTOR(S) : Rune V. Glanvall

Figure 4:
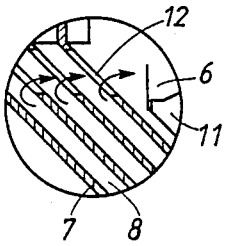

It is certified that error appears in the above-identified patent and that said Letters Patent is hereby corrected as shown below:

Column 1, between lines 60 and 61 insert:

--Fig. 4 shows an enlarged detail of Figure 3 as seen within circle 4-4.--

Column 2, line 23, delete "Close to the motor shaft" and insert:

--As seen in Figure 4,--.

Line 24, after "holes 12" insert --near the motor shaft--.

Signed and Sealed this

Eighth Day of November, 1988

*Attest:*

DONALD J. QUIGG

*Attesting Officer*

*Commissioner of Patents and Trademarks*